US006266938B1

(12) United States Patent
Sheu et al.

(10) Patent No.: US 6,266,938 B1
(45) Date of Patent: Jul. 31, 2001

(54) STEEL FLOOR STRUCTURE

(76) Inventors: Chyi Sheu; Sin-Yuan Lu, both of P.O. Box 90, Tainan City (TW)

( * ) Notice: Subject to any disclaimer, the term of this patent is extended or adjusted under 35 U.S.C. 154(b) by 0 days.

(21) Appl. No.: 09/500,057

(22) Filed: Feb. 8, 2000

(51) Int. Cl.[7] ..... E04B 1/18
(52) U.S. Cl. ..... 52/633; 52/252; 248/676
(58) Field of Search ..... 52/337, 414, 649.1, 52/650.3, 653.1, 649.2, 236.8, 236.5

(56) References Cited

U.S. PATENT DOCUMENTS 4,333,285 * 6/1982 Koizumi et al. ..... 52/252
4,621,938 * 11/1986 Weilow ..... 403/217
4,660,799 * 4/1987 Butland ..... 248/676

* cited by examiner

*Primary Examiner*—Carl D. Friedman
*Assistant Examiner*—Steve Varner

(57) ABSTRACT

A steel floor structure includes steel columns, steel beams, surrounding frames around the columns and the beams, horizontal frames around the beams, connectors, anti-bend means, floor steel bars, reinforcing catch steel bars, various kinds of connect means, and net plates laid on outer surfaces of the structure and used as outer concrete forms to keep concrete inside. So the steel frame floor can be assembled quickly and have high structural strength and a good wholeness.

5 Claims, 8 Drawing Sheets

STEEL FLOOR STRUCTURE

BACKGROUND OF THE INVENTION

This invention related to a steel floor structure, particularly to one consisting of main steel members of columns and beams, reinforcing connectors fixed on proper locations of a side wall of the steel beam, horizontal support frames consisting of straight steel bars and link fix rods provided between the steel beams, connectors connecting the horizontal frames and the steel beams, plural anti-bend means located between two horizontal support frames and having two ends connected with the reinforcing connectors of the steel beams, floor steel bars arranged to pass through the space between the two horizontal frames, plural catch steel bars connected on a side walls of the main steel members and having one end extending in the horizontal support frame and one end curved to form a hook, and plural net plates laid on outer surfaces of the steel floor structure and used as an outer concrete form plates. Then this steel floor structure can not only be assembled quickly, but also has high structural strength and a good wholeness.

A conventional building floor A has a structure as shown in FIG. 1, having the following drawbacks.

1. A conventional building floor mostly uses corrugated steel plates (deck) and shearing force bolts to connect to beams. Contacting portions of the bolts and the beams are rather difficult to treat rust-resistant measure, which results in weak points of the building structure.

2. Conventional reinforced concrete buildings or steel frame concrete buildings generally have floors constructed with corrugated steel plates, hampering continuity of concrete steel columns and steel beams to affect the wholeness of the building structure so that the columns and the beams do not have the stress they should have, or complete concrete protective and sharing force against earthquakes. Thus the conventional reinforced concrete buildings or the conventional steel frame concrete building lose original functions they should have. Then concrete surrounding the columns and the beams only have a second function of protecting them from erosion.

3. The conventional corrugated floor makes up a rough ceiling of wave shapes, not conforming to Chinese customs (they prefer flat ceilings), so the floor has to be decorated with additional work, wasting resources, reducing the height of the room and living quality.

4. The conventional steel plates and concrete have inferior combination with each other, using corrugated plates as form plates. So concrete does not have the same thickness owing to the corrugated plates, and owing to the same direction of the arrangement of the corrugated plates, the concrete may be liable to produce crevices or cracks to cause water sipping.

5. The conventional corrugated plates are apt to hamper flow of concrete in concrete pouring process to affect the quality of the concrete.

SUMMARY OF THE INVENTION

The main objective of the invention is to supply a steel floor structure, which includes steel columns, steel beams, surrounding frames around the columns and the beams, horizontal frames around the beams, connectors, anti-bend means, floor steel bars, reinforcing catch steel bars, and net plates laid on outer surfaces of the structure and used as outer concrete form plates. So the steel frame floor can be assembled quickly and have high strength and a good wholeness.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
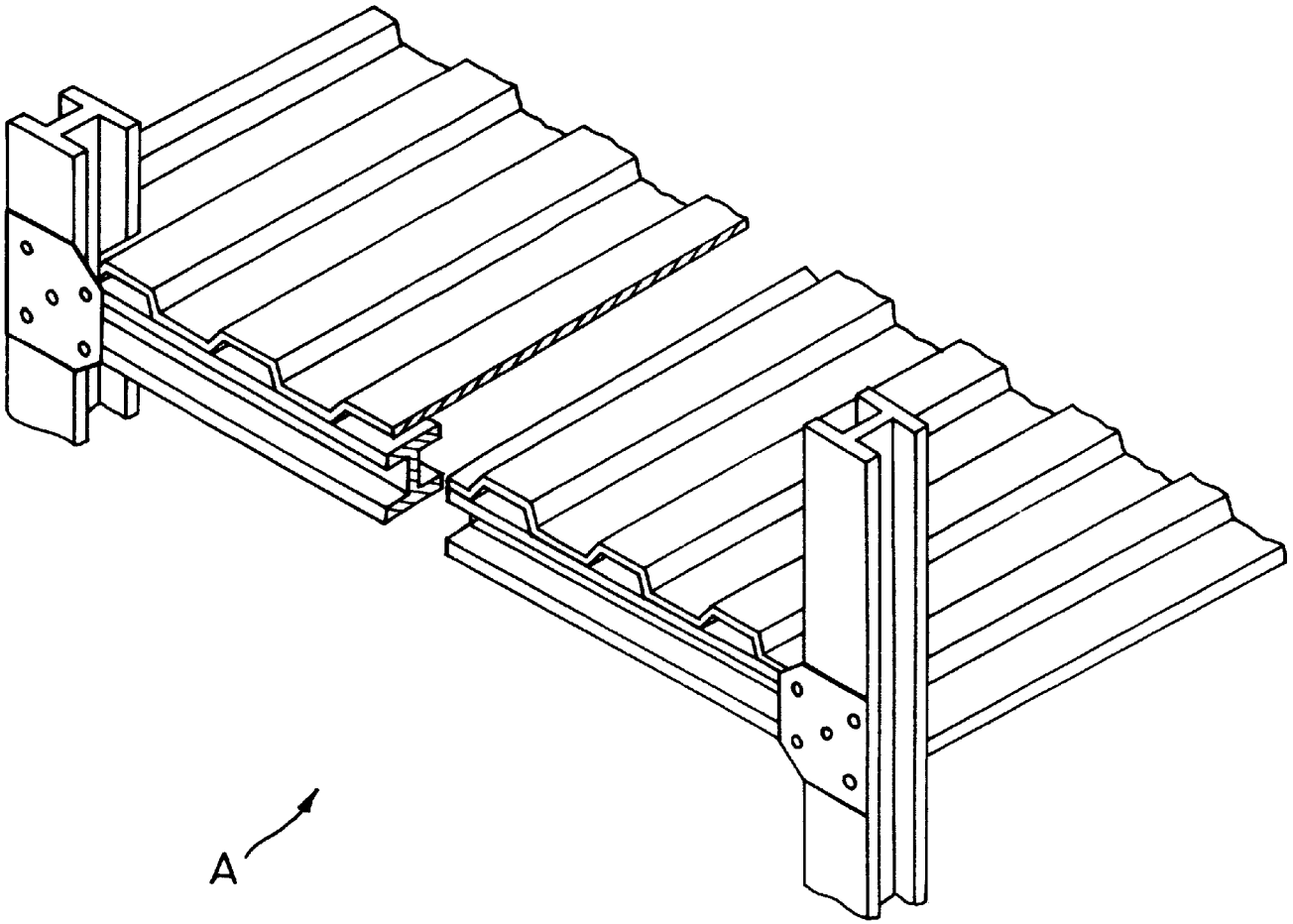
FIG. 1 (PRIOR ART)
FIG. 1 is a perspective view of a conventional known building steel floor.
Figure 2:
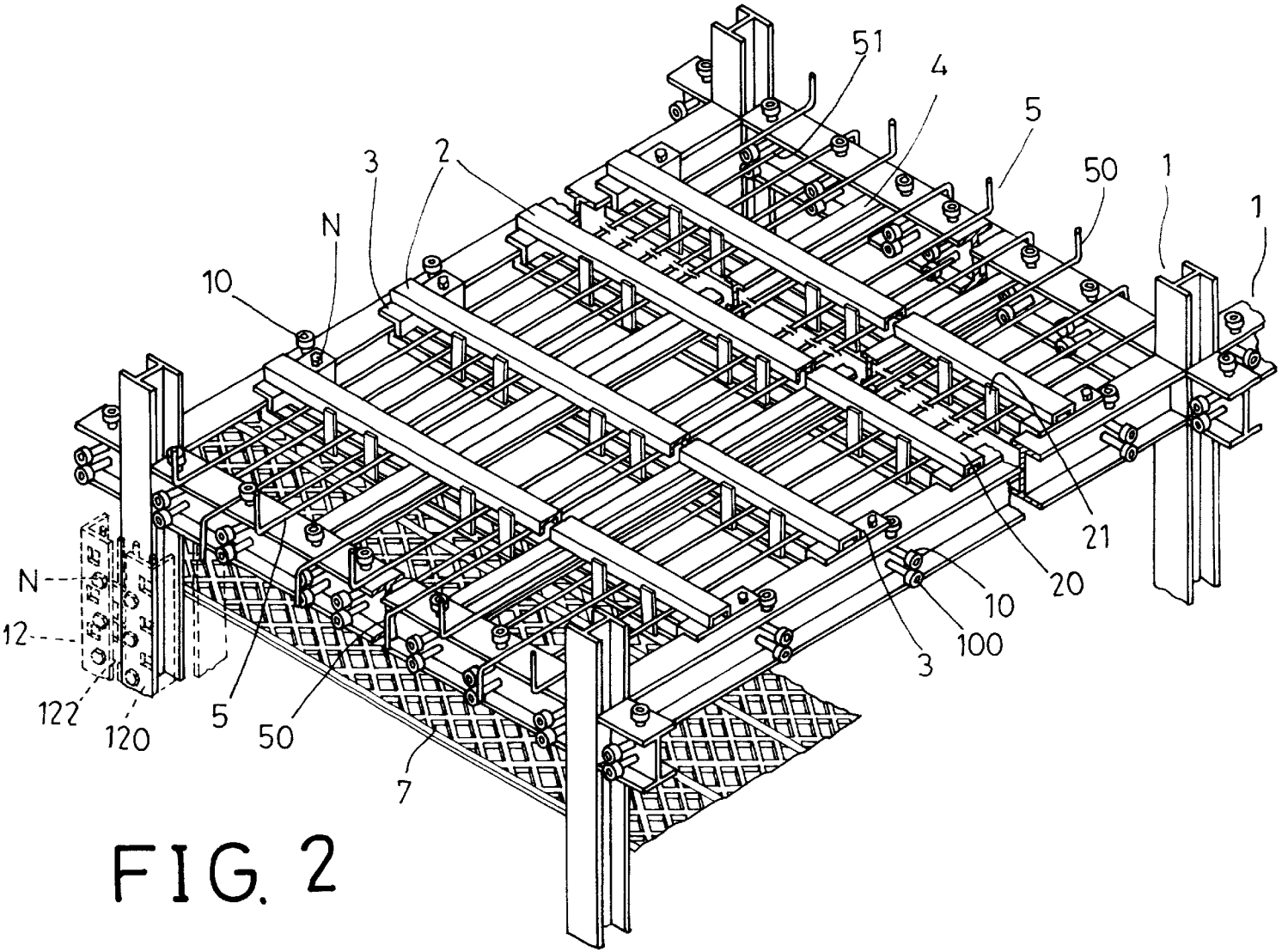
FIG. 2 is a perspective view of a steel floor structure in the present invention.
Figure 3:
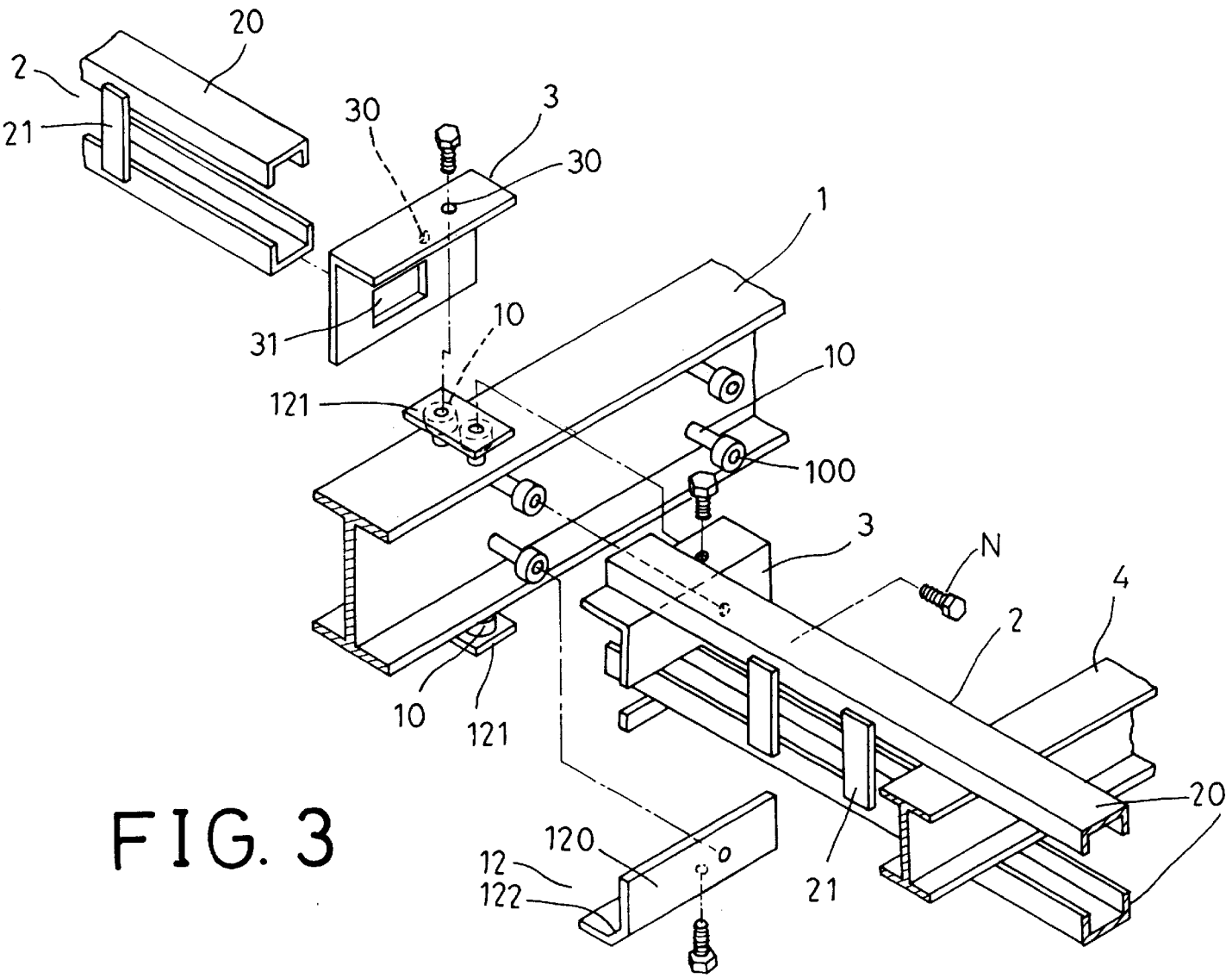
FIG. 3 is an exploded perspective view of a support frame connected to a beam in the present invention.
Figure 4:
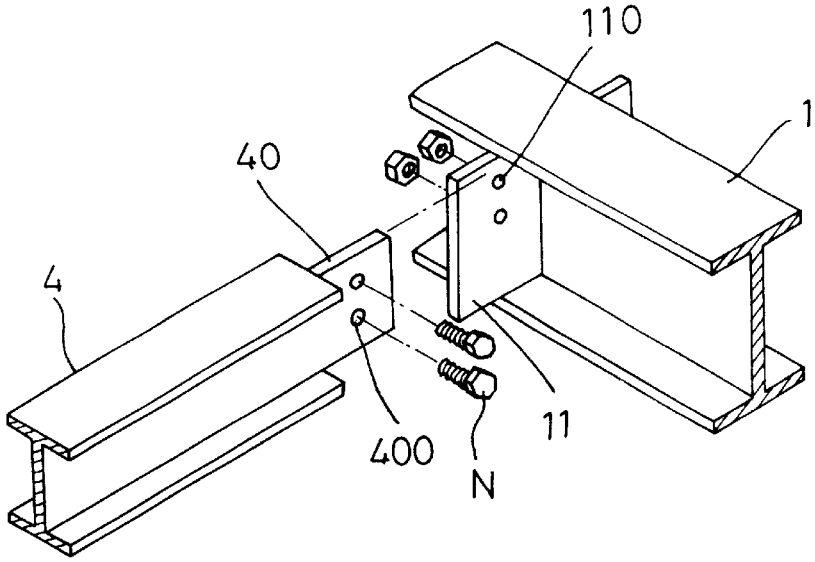
FIG. 4 is a perspective view of an anti-bend means to be connected to the beam in the present invention.
Figure 6:
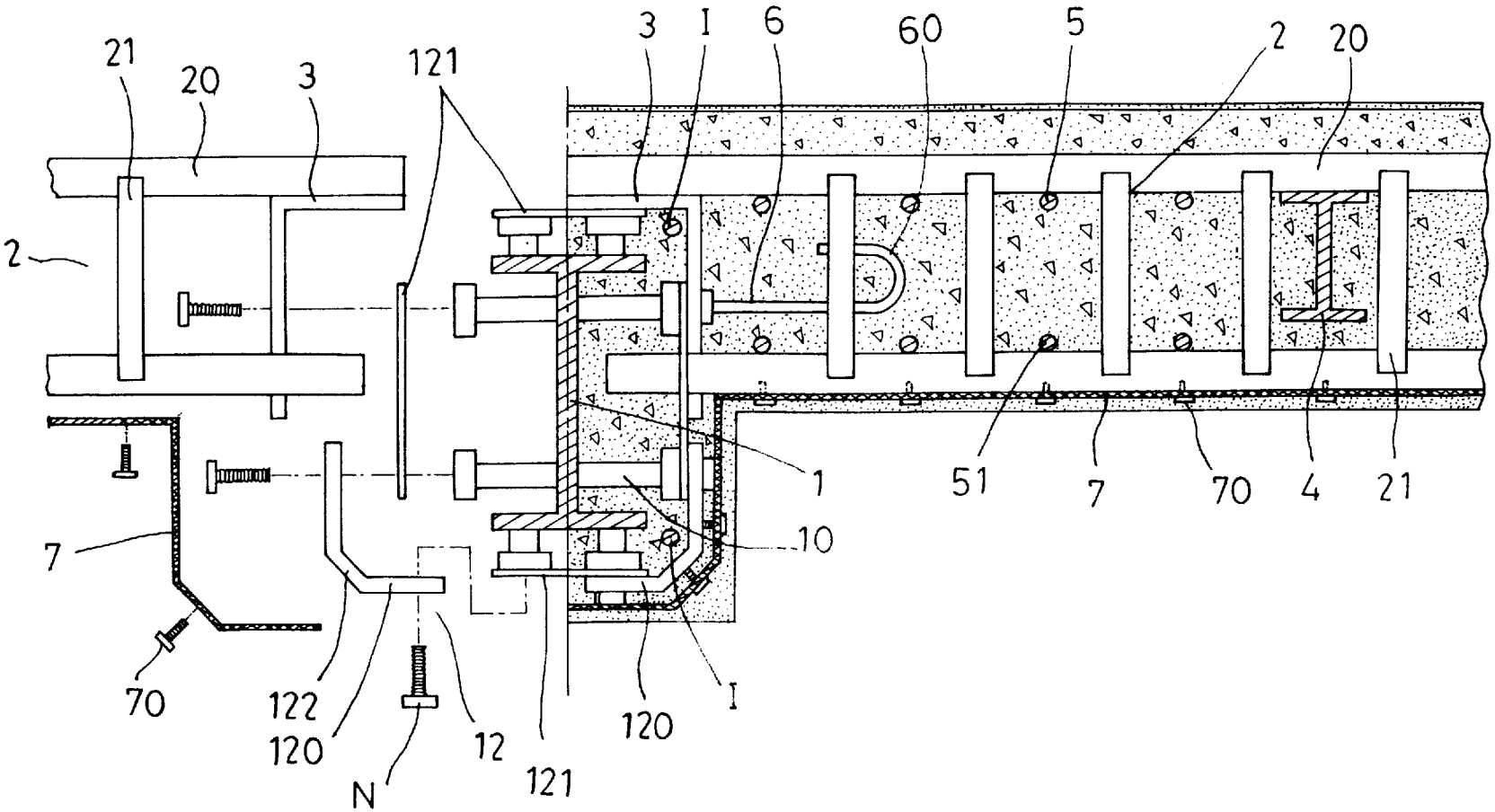
FIG. 6 is a cross-sectional view of the steel floor and the beam in the present invention.

A steel floor structure in the present invention, as shown in FIGS. 2, 3 and 4, includes main steel members 1 of columns and beams, plural connect means 10 in the form of shearing force bolts fixed in advance on surfaces of the main steel members 1 and having one end welded by electric welding with the surfaces of the main steel members 1 and the other end extending out to form a connect part 100 to connected to other connect means. The steel floor structure further includes reinforcing connectors 11 of a plate shape fixed on a side wall of the main steel member 1 of the beams and extending outward and having connect holes 110 in the surface (as shown in FIG. 4). Further, the steel floor structure also includes surrounding frames 12 around the main steel members 1 of the column and around the lower outer circumferences of the beams. Each surrounding frame 12 includes plural corner frames 120 located at outer end of the main steel members 1, and those corner frames 120 extending down the main steel members of the beams have a sloped guide surface 122 (referring to FIGS. 2, 3 and 6) to help flowing of concrete and have the surfaces screwed with the connect means 10. Some of the corner frames 120 have flow holes in advance for concrete to flow down through. Link plates 121 are connected between every two opposite corner frames 120 with screws. The interior space between surrounding frames and steel columns (beams) have plural reinforcing steel bars (as shown in FIG. 6), increasing strength and hardness of the auxiliary structure, and further strengthening the structural system and increasing earthquake-resistant force by surrounding the beams and the columns.

Figure 7:
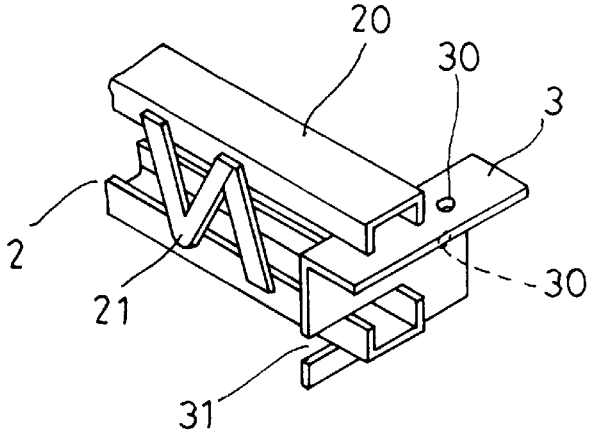
FIG. 7 is a perspective view of another embodiment of a support frame in the present invention.

The plural horizontal support frames 2 as shown in FIGS. 2 and 3, are positioned between two main steel members 1 of the beams, having two properly flat surfaces of straight members 20 facing each other. The straight members may be channels, jointed angles, or steel plates having the same function, and the flat surfaces of them located on or down the surfaces of the building floor for laying and fixing net plates 7 thereon. Plural link and fix rods 21 are fixed on two sides of two opposite straight members 20, arranged in a ladder shape (as shown in FIG. 3) or a bending girder shape (as shown in FIG. 7).

Figure 8:
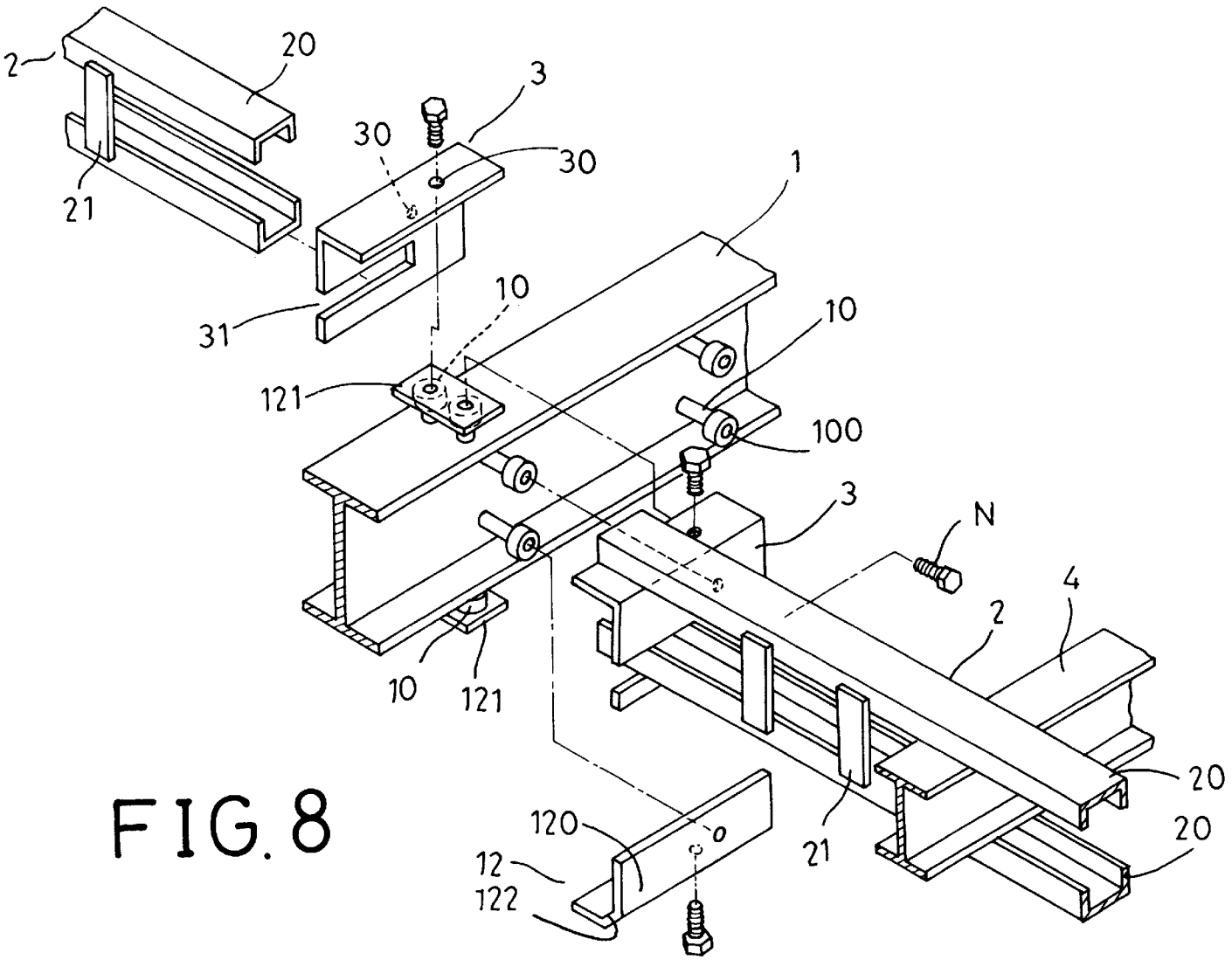
FIG. 8 is a perspective view of another embodiment of a connector in the present invention; and, FIG. 9 is a perspective view of another embodiment of a hanging means being used in the present invention.

The connectors 3 are located between two horizontal support frames 2 (as shown in FIGS. 2 and 3), fixed with the main steel member 1 of the beams, having an inverted L-shape and holes in an horizontal and a vertical portion to correspond to the connect means 10 of the main steel members 1 for bolts N to screw together. The vertical portion of the connectors 3 further has a long slot 31 opening to the left side (as FIGS. 3 and 8 shows it may be a slot or a hole) for the lower straight member 20 to fit through therein. The lower edge of the vertical portion of the connector 3 connects to another connect means 10 and linking plates 121, and an upper flat surface of the connector 3 is for the other straight member 20 of the horizontal support frame 2 to lie on.

Figure 5:
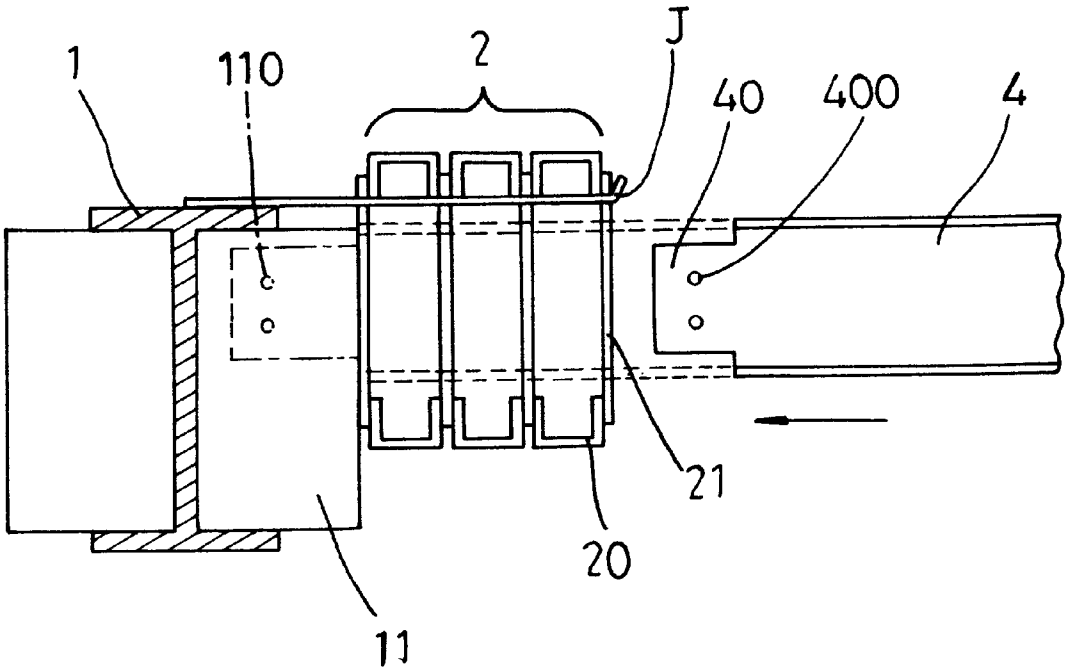
FIG. 5 is a side view of a hanging means used in the present invention.

Plural anti-bend means 4 are arranged between the two horizontal support frames 2, having two ends connected respectively to the two opposite beams, as shown in FIGS. 2, 4 and 5, having a connect end 40 with connect holes 400 for bolts N to tightly secure together. The anti-bend means 4 may be steel of some shape or a girder shape.

Floor steel bars 5 are arranged to lie through the space between the two horizontal support frames 2, having two ends fixed on the upper surfaces of the main steel members 1 of the beams and the two ends each having a fix extension bending down or up the outer side of the main steel member 1 of each beam, as shown in FIG. 2. Then the floor steel bars 5 may be easily connected to steel means of other wall structures. Further insert steel bars 51 are provided to pass on the straight members 20 of the horizontal support frame 2 (as shown in FIG. 6), having two ends fixed with an inner wall of the two opposite beams (by means of welding, bolts or binding).

The plural catch steel bars 6 shown in FIG. 6 are connected to the connect means 10 of the main steel members 1, having one end extending in the floor structure and the horizontal support frames 2, and the other end curved to form a hook 60 to strengthen catching effect of the steel floor structure against concrete.

The net plates 7 are attached on an outer surfaces of the combined steel floor structure just described, connected tightly with the steel frames of the structure with bolts 70, used as concrete form plates instead of wooden concrete forms to save troublesome work of binding, nailing and removing wooden concrete forms.

In assembling the steel floor structure, firstly, the main steel members 1 of the columns and the beams are constructed, and one of the beam is provided with plural temporary hanging means J (such as a welded steel bar or plate screwed with) at its side end. Next, the connectors 6 are placed through between two ends of the horizontal support frames, and the support frames 2 are hung on the hanging means J as shown in FIG. 6. Then the anti-bend members 4 are inserted through the support frames 2, with the connect end 40 fitted together with the reinforcing connect means 11 to let the connect holes 400 face the holes 110 for bolts N to screw together. Next, as shown in FIGS. 2 and 4, the horizontal support frames 2 are arranged equidistantly on the anti-bend members 4 (as shown in FIG. 2). Two ends of each support frame 2 are connected tightly to the connect means 10 of the main steel members 1 of the beams by means of the connectors 3. Then the surrounding frames 12 are combined around the main steel members 1 of the columns and around the lower portions of the beams, letting the linking plates 121 of the surrounding frames 12 connected to the corner frames 120 and the surfaces of the corresponding connectors 3 (as shown in FIG. 6). After that, the floor steel bars 5 are laid through the space between the support frames 2 and placed on the main steel member 1 of the beams, with the fix extensions 50 located the outer sides of the main steel members 1 of the beams (as shown in FIG. 2). Then the insert steel bars 51 are laid on the straight members 20 of the support frames 2 to strengthen the structure, and the catch steel bars 6 are connected to the connect means 10 inside the main steel members 1, letting the end hook 60 extend in the support frame (2) structure (as shown in FIG. 6). Lastly the net plates 7 are fixed on an outer surfaces of the combined structure with bolts 70, so that concrete may be poured in the steel floor structure. After the concrete hardens, the surfaces of the floor can be coated with grouting (or with other decorative means).

Figure 9:
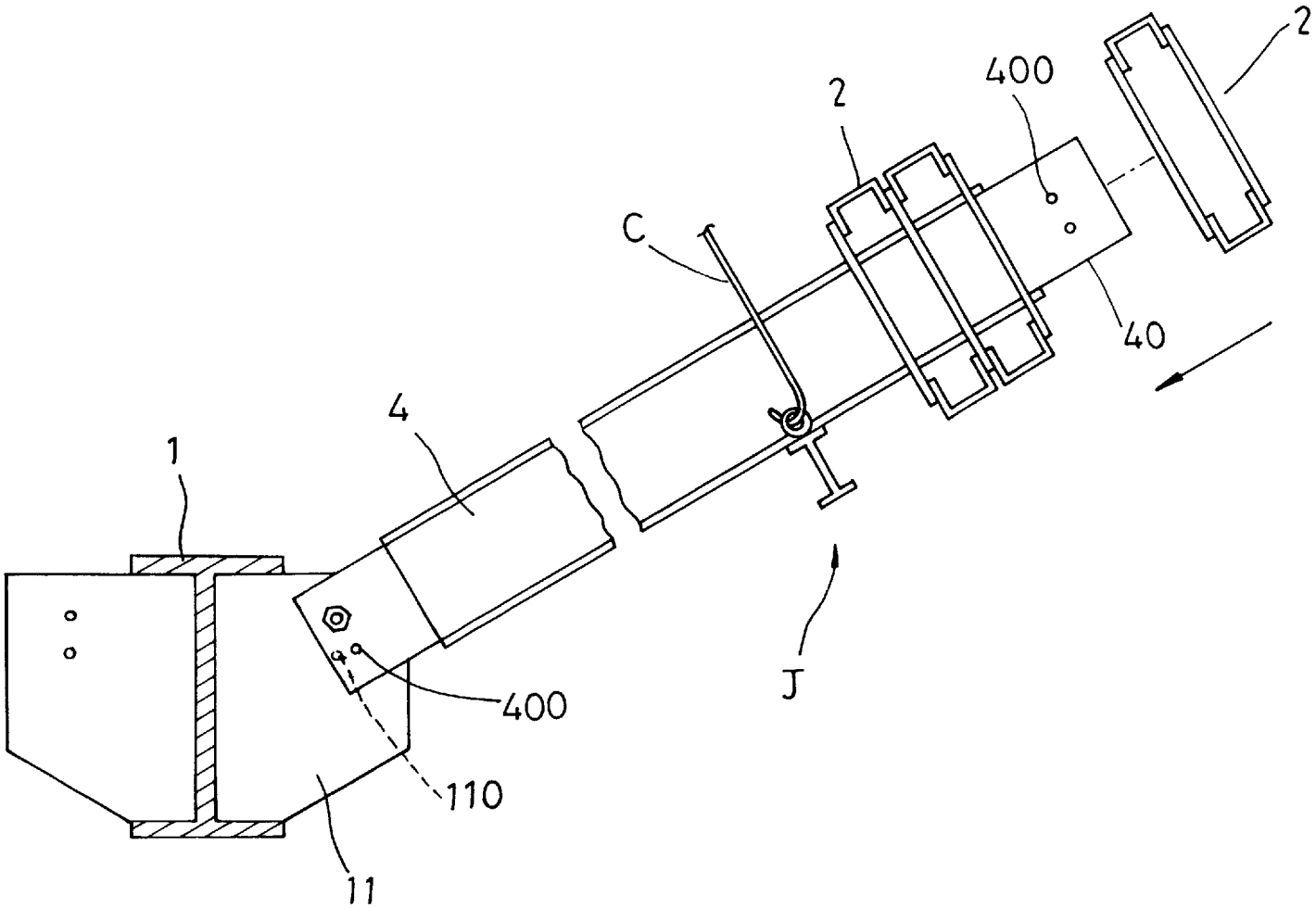

In addition, another embodiment of constructing the support frames 2 is shown in FIG. 9. A hanging means J is fixed on the bottom of the anti-bend means 4, and the connect holes 400 of the connect end 40 of the anti-bend member 4 is temporarily connected to the connect holes 110 of the reinforcing connector 11, permitting the anti-bend member rotate upward with the bolted point as a pivot. Then a hanging crane is used to hang up the anti-bend members 4 in a sloped condition, hooking the hanging means J and insert the support frames 2 through the hanging means J and move the anti-bend members horizontal, with the connect ends 40 of the anti-bend members 4 connected to the reinforcing connectors 11 of the main steel members 1. Then the support frames 2 are arranged on the anti-bend members in the preset distance between (as shown in FIG. 2), and two ends of each support frame 2 are connected to the connect means 10 of the main steel members 1 of the beams by means of the connectors 3, finishing another embodiment of the support frames 2.

The steel floor structure of the invention has the following advantages, as may be understood from the aforesaid description.

1. The main steel members have the connect means fixed thereon in advance to connect to other connect means, speeding up assembling and connecting processes, keeping the floor and the beams tightly connected with each other, and upgrading the strength of the whole structure.

2. The main steel members, the reinforcing connectors, the surrounding frames, the horizontal support frames, the anti-bend members, etc. can be produced in a factory, so constructing may be quick, the quality stable, efficiency high, attaining the target of automotive production.

3. The main steel members have connect means to connect tightly with bolts to the column and the beam structure, the horizontal support frames, and other reinforcing steel members, forming the wholeness of the structure and letting concrete combining tightly with the column and the beam structure and the floor structure, improving the drawbacks of the conventional structure of inferior combination of corrugated steel plates and concrete, and upgrading anti-earthquake force of the whole structure.

4. The floor steel bars in the floor structure have bent fix extensions formed in two ends of each steel bar to easily connect to other wall structures, making the structure have practical worth.

5. The net plates are used instead of concrete form plates and fixed with the steel frames with bolts, connecting the main steel members, the support frames and the net plates, and in addition the net plates have high toughness to constrict completely the concrete inside the net plates, and the concrete may not easily rupture or break to pieces in case of earthquakes or shocks.

6. The net plates taking place of concrete form plates are not only easily installed, but have no wooden form plate scraps or no miscellaneous matters on the wooden form plates to mix in concrete, and besides, needing no support means, linking bars or hanging rods for wooden concrete form plates. Then working space may become larger than otherwise, without needing space for storing them, ensuring to keep clean the site environment, wasting no wood or forest resources.

7. The steel floor structure mainly uses steel members of various shapes, anti-bend members, and support frames of a girder shape which are fabricated in a factory, and steel bars and concrete as auxiliary materials used at the constructing site, and the net plates are used as concrete form plates, so that the connection is reliable, reducing work points and the number of workers, resulting in easy management and guaranteed construction quality.

8. The net plates used instead of concrete forms or corrugated steel plates can let air bubbles in concrete pouring escape through small net holes, and concrete can fill up the net holes not to cause so called *bee hive* condition in concrete as easily happens in the conventional reinforcing steel concrete buildings. Besides, no work is needed to remove concrete form plates after concrete hardens. The surfaces of the floor may be easily finished flat and smooth to keep stabilized grouting on the surfaces by means of the rough surfaces of the net plates.

9. The finished building floor can have a ceiling as flat and smooth as the conventional ceiling to conform to the Chinese traditional liking, improving the drawbacks of the corrugated steel plate floor.

While the preferred embodiment of the invention has been described above, it will be recognized and understood that various modifications may be made therein and the appended claims are intended to cover all such modifications which may fall within the spirit and scope of the invention.

What is claimed is:

1. A steel floor structure comprising:

a main steel structure consisting of columns and beams made of main steel members, said main steel members have plural connect means fixed on the surfaces inadvance, and plural reinforcing connectors fixed on proper locations on a side wall of said main steel members of said beams;

said connect means are shaped as shearing force nails, having one end welded with the surface of said main steel members as integral, and the other end extending out to connect to other connect means;

plural support frames arranged horizontally between said main ateel members of said beams, and consisting of plural straight members and link and fix rods;

plural connectors connecting said horizontal support frames and said main steel members of said beams;

plural anti-bend members laid to extend the space between an upper and a lower support frames, having two ends respectively connected to said reinforcing connectors of said main steel members of said beam;

plural floor steel bars located to extend through the space between the upper and the lower support frames;

plural net plates fixed on an outer surface of said combined steel floor structure, used as concrete forms for pouring concrete; and said above components for quick assembly to form said steel floor structure having a high structural strength.

2. A steel floor structure comprising:

a main steel structure consisting of columns and beams made of main steel members, said main steel members have plural connect means fixed on the surfaces in advance, and plural reinforcing connectors fixed on proper locations on a side wall of said main steel members of said beams;

a surrounding frame is respectively provided at an outer circumference of said steel columns and a lower end of said beams, having plural corner frames fixed to surround the peripheral edge of the main steel members;

said corner frame located at a lower end of said main steel members of said beam have a sloped guide surface to help concrete to flow down, said corner frames screwed with said connect means of said main steel members, some of said corner frames having plural concrete flow holes for concrete to flow smoothly;

plural support frames arranged horizontally between said main steel members of said beams, and consisting of plural straight members and link and fix rods;

plural connectors connecting said horizontal support frames and said main steel members of said beams;

plural anti-bend members laid to extend the space between an upper and a lower support frames, having two ends respectively connected to said reinforcing connectors of said main steel members of said beam;

plural floor steel bars located to extend through the space between the upper and the lower support frames;

plural net plates fixed on an outer surface of said combined steel floor structure, used as concrete forms for pouring concrete; and said above components for quick assembly to form said steel floor structure having a high structural strength.

3. A steel floor structure comprising:

a main steel structure consisting of columns and beams made of main steel members, and plural reinforcing connectors fixed on proper locations on a side wall of said main steel members of said beams;

plural support frames arranged horizontally between said main steel members of said beams, and consisting of plural straight members and link and fix rods;

plural connectors connecting said horizontal support frames and said main steel members of said beams;

said connectors are of an inverted L-shape, having a vertical portion provided with a slot for a lower straight member of said horizontal support frame to fit through, said vertical portion and a horizontal portion having holes to correspond to said connect means of said main steel members for bolts to screw together, said lower edge of said vertical portion connected to other connect means and linking plates, and a horizontal flat surface of said connector receiving said upper straight member of said support frame;

plural anti-bend members laid to extend the space between an upper and a lower Support frames, having two ends respectively connected to said reinforcing connectors of said main steel members of said beam;

plural floor steel bars located to extend through the space between the upper and the lower support frames;

plural net plates fixed on an outer surface of said combined steel floor structure, used as concrete forms for pouring concrete; and said above components for quick assembly to form said steel floor structure having a high structural strength.

4. A steel floor structure comprising:

a main steel structure consisting of colums and beams made of main steel members, and plural reinforcing connectors fixed on proper locations on a side wall of said main steel members of said beams;

plural support frames arranged horizontally between said main steel members of said beams, and consisting of plural straight members and link and fix rods;

plural connectors connecting said horizontal support frames and said main steel members of said beams;

plural anti-bend members laid to extend the space between an upper and a lower support frames, having two ends respectively connected to said reinforcing connectors of said main steel members of said beam;

plural floor steel bars located to extend through the space between the upper and the lower support frames;

plural net plates fixed on an outher surface of said combined steel floor structure, used as concrete forms for pouring concrete;

wherein in order to facilitate to install said anti-bend members, plural hanging means are temporarily fixed on an upper surface of the main steel member of said beam, said support frames are arranged on said hanging means, said anti-bend members are positioned in place, then said support frames are arranged in orderly position and connected tightly to said beams by means of said connectors; and said above components for quick assembly to form said steel floor structure having a high structural strenght.

5. A steel floor structure comprising:

a main steel structure consisting of columns and beams of main steel members, and plural reinforcing connectors fixed on proper locations on a side wall of said main steel members of said beams;

plural support frames arranged horizontally between said main steel members of said beams, and consisting of plural strainght members and link and fix rods;

plural connectors connecting said horizontal support frames and said main steel members of said beams;

plural anti-bend members laid to extend the space between an upper and a lower support frames, having two ends respectively connected to said reinforcing connectors of said main steel members of said beam;

plural floor steel bars located to extend through the space between the upper and the lower support frames;

plural net plates fixed on an outer surface of said combined steel floor structure, used as concrete forms for pouring concrete; and wherein said support frames are assembled by temporarily screwing tightly one end of said anti-bend members with said reinforcing connectors, fixing a hanging means on the bottom of said anti-bend member, said anti-bend member being hung up in a sloped condition by a hanging crane hooking said hanging means, said Support frames are inserted through to face each other, and said support frames are positioned tightly after said connect ends of said anti-bend member are screwed tightly together with said reinforcing connectors; and said above components for quick assembly to form said steel floor structure having a high structural strength.

* * * * *